United States Patent [19]

Diedrich

[11] Patent Number: 4,667,754

[45] Date of Patent: May 26, 1987

[54] FLEXIBLE PLUG FOR OBTAINING SOIL SAMPLES DURING DRILLING OPERATIONS

[75] Inventor: John C. Diedrich, LaPorte, Ind.

[73] Assignee: Diedrich Drilling Equipment, Inc., LaPorte, Ind.

[21] Appl. No.: 796,923

[22] Filed: Nov. 12, 1985

[51] Int. Cl.[4] ..... E21B 25/02

[52] U.S. Cl. ..... 175/249; 175/58; 175/394; 175/403

[58] Field of Search ..... 175/20, 58, 244, 249, 175/253, 394, 403

[56] References Cited

U.S. PATENT DOCUMENTS

| | | | |
|---|---|---|---|
| 2,173,677 | 9/1939 | Boyd | 175/249 |
| 3,095,051 | 6/1963 | Robinsky et al. | 175/394 |
| 3,136,376 | 6/1964 | Robinsky | 175/238 |
| 3,805,900 | 4/1974 | Sainsbury | 175/20 |
| 3,878,904 | 4/1975 | Dobson | 175/58 |
| 4,248,313 | 2/1981 | Bonca | 175/394 |

*Primary Examiner*—Stephen J. Novosad
*Assistant Examiner*—Terry Lee Melius
*Attorney, Agent, or Firm*—Thomas J. Dodd

[57] ABSTRACT

A flexible plug used in combination with a hollow stem auger and connected drill head which has a hollow housing. The plug includes a plurality of flexible shape-retaining arcuate projections extending towards the plug central axis.

2 Claims, 6 Drawing Figures

FLEXIBLE PLUG FOR OBTAINING SOIL SAMPLES DURING DRILLING OPERATIONS

SUMMARY OF THE INVENTION

This invention relates to a plug, and will have special application to a plug having flexible protrusions for use with a hollow stem auger and drill head during soil drilling operations.

Soil drilling is a long established process used by architects to determine the feasibility of certain areas for sinking a building foundation. Equipment used in soil drilling normally includes a hollow stem auger and a connected drill head having a hollow housing. After the soil has been drilled to the desired depth, accumulated soil in the hollow stem is removed and a split tube sampler is then inserted into the stem and the stem reinserted into the drilled hole to draw a soil sample from the bottom of the hole. The major problem encountered in such a process is that when drilling through sandy soil, the sand accumulates to a significant level in the stem, which requires a significant length of time to remove before the sampler is inserted.

The plug of this invention includes arcuate, inturned flexible finger projections which act as a one way valve between the stem and drill head. Soil is prevented from entering the stem by the projections during drilling. When a soil sample is required, the split tube may be pushed through the plug to obtain the sample and then removed. By eliminating the soil removal step, valuable time and money are saved.

Accordingly, it is an object of this invention to provide a flexible plug which is used for preventing soil intrusion into a hollow stem auger during soil drilling.

Another object of this invention is to provide for a flexible drill plug which permits an engineer to take soil samples during soil drilling.

Another object of this invention is to provide for a flexible drill plug which is durable and economical to produce.

Other objects of this invention will become apparent upon a reading of the following description.

BRIEF DESCRIPTION OF THE DRAWINGS

A preferred embodiment of the invention has been depicted for purposes of illustration wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

Figure 1:
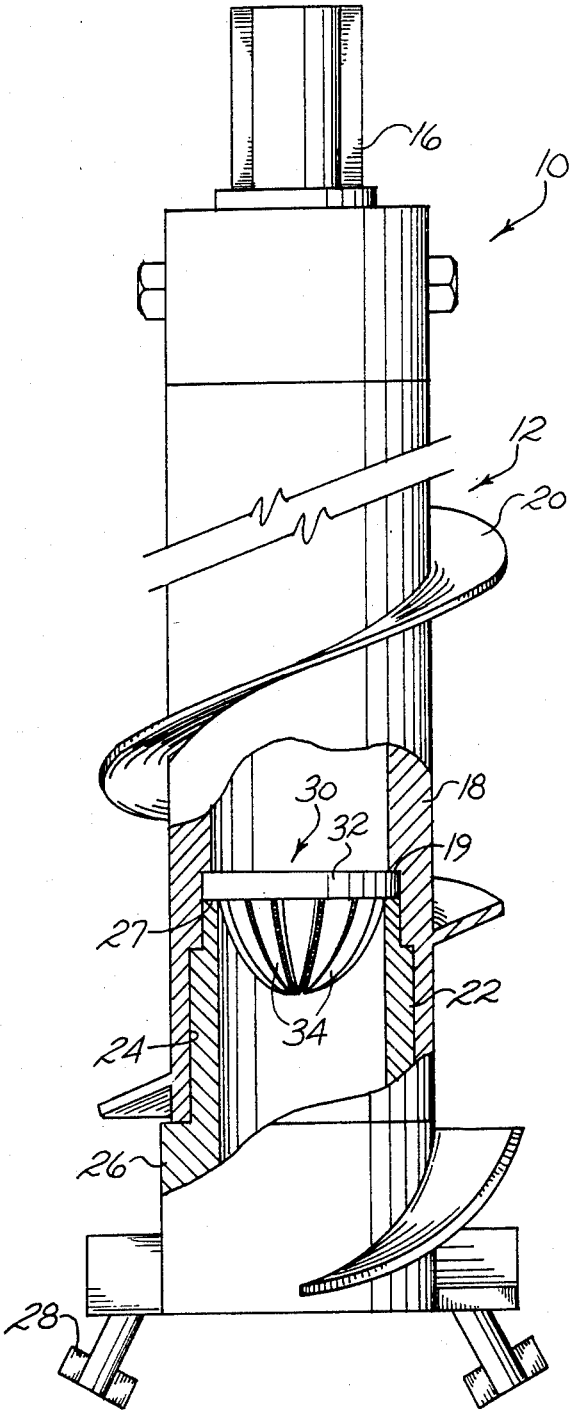
FIG. 1 is a fragmentary elevational view of a soil drilling head and auger with portions cut away to illustrate the plug of this invention.
Figure 2:
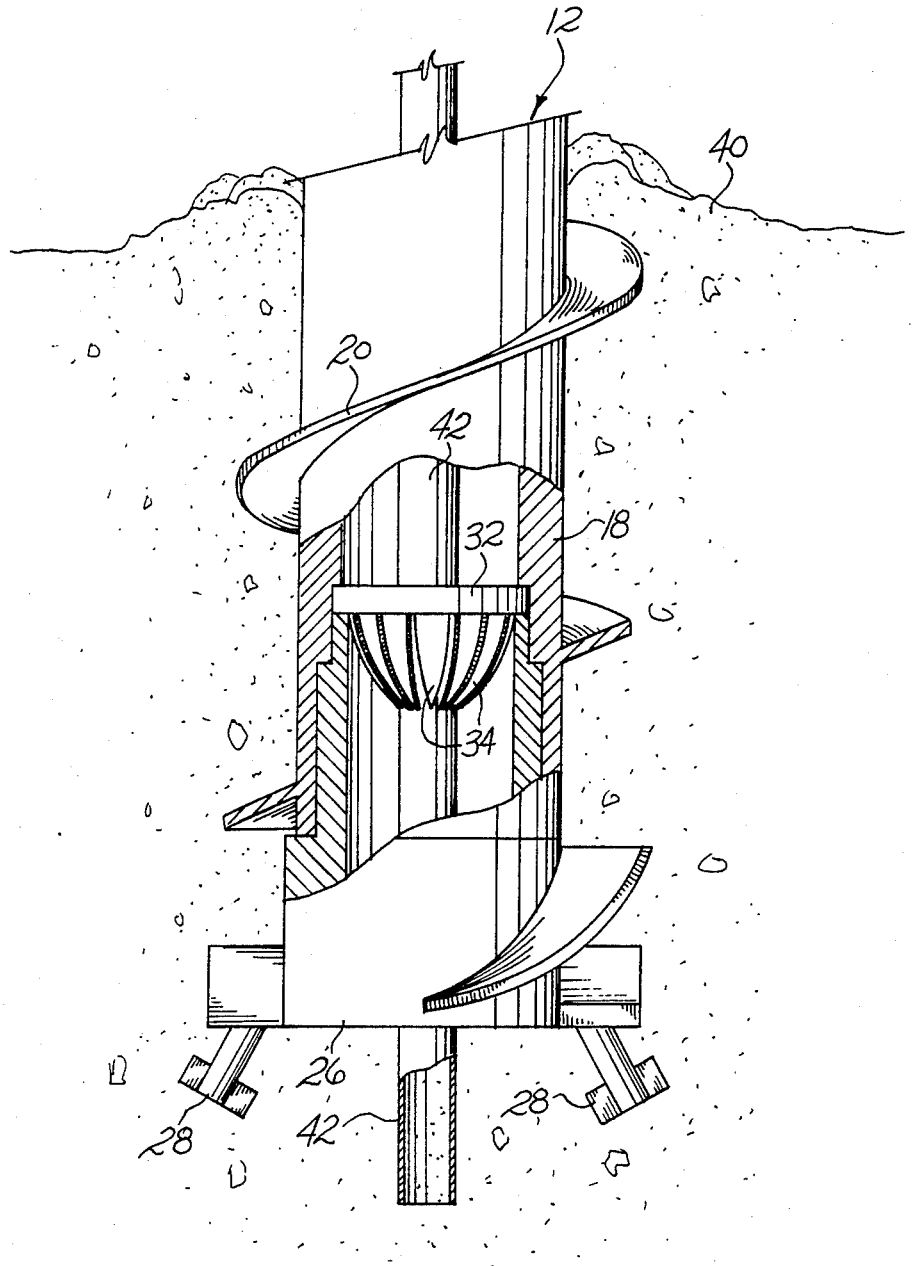
FIG. 2 is a fragmentary elevational view similar to FIG. 1 and showing a soil sampler inserted through said plug.
Figure 3:
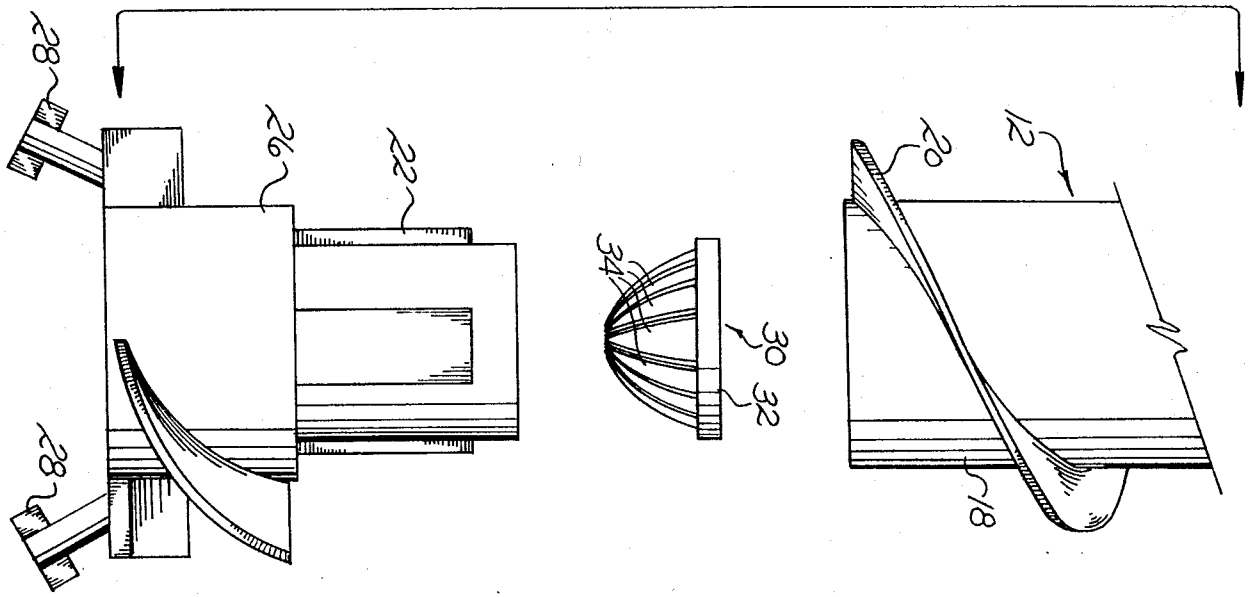
FIG. 3 is an exploded view of the soil drilling equipment utilizing the plug.

FIGS. 1–3 depict a soil drilling apparatus 10 which generally includes a hollow stem auger 12 and a connected drill head 14. An adapter cap 16 is connected to auger 12 and transfers the torque from a motor shaft (not shown) to the auger which cause rotation and advancement of apparatus 10 into the soil. Auger 12 preferably includes a hollow stem 18 and a continuous spiral blade 20. Drill head 14 is connected to auger 12 in any conventional manner which allows simultaneous rotation of the drill head and auger, such as spline 22, keyway 24, and cross bolts (not shown). Drill head 14 includes a hollow housing 26 which houses one or more drill bits 28. Apparatus 10 as so far described is a conventionally used soil drilling apparatus.

Figure 4:
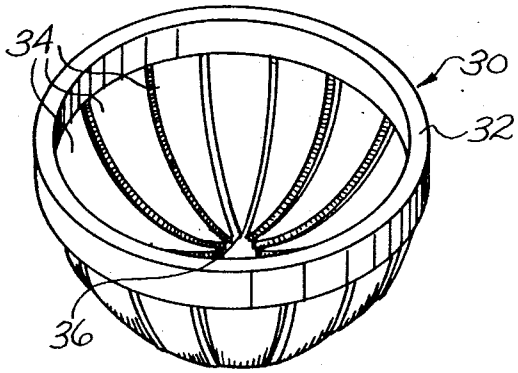
FIG. 4 is a perspective view of the plug.
Figure 5:
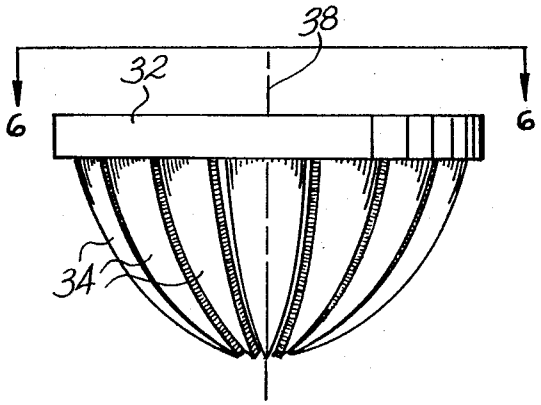
FIG. 5 is an elevational view of the plug.
Figure 6:
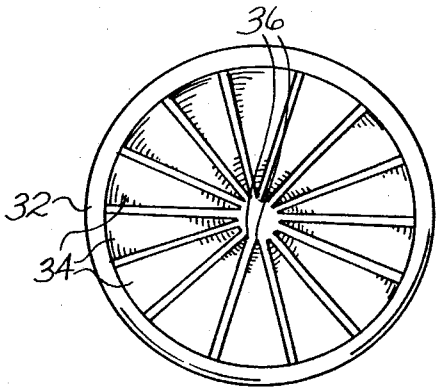
FIG. 6 is a plan view of the plug.

FIGS. 4–6 depict a soil plug 30 which includes a rim 32. A plurality of flexible shape-returning projections 34 extend arcuately inwardly from rim 32 to a tapered point 36 spaced from the center axis 38 of the plug. Projections 34 form a cup like shape and are urged into edge to edge abutting contact or overlapping arrangement with one another during initial drilling to generally prevent the passing of soil. Plug 30 is preferably formed of a durable, yet resilient material, such as plastic.

FIGS. 1–2 depict plug 30 in use during drilling and sampling operations. Plug 30 is positioned as shown in FIG. 1 with rim 32 secured between a shoulder 27 of drill head housing 26 and a shoulder 19 of auger stem 18 with plug projections 34 extending towards the terminal end of drill head 14. As drill head 14 and auger 12 are rotated and advanced into soil 40, the force of the soil upon plug projections 34 causes the projections to compact and generally seal the auger stem 18 against the entry of soil. Soil 40 is removed from the resulting hole by auger blade 20 which causes the loosened soil to pass about the stem.

When an engineer wishes to take a soil sample, rotation of auger 12 is ceased and a sampling device such as a smooth split hollow tube 42 is inserted through auger stem 18 and plug 30 as shown in FIG. 2. Projections 34 allow tube 42 to pass through plug 30 into the underlying soil. Tube 42 will generally be equipped with a shoe (not shown) which allows the tube to be forced deep enough into the soil (i.e. below the terminal end of drill head 14) to allow an accurate sample to be taken. Tube 42 is then pulled up and the soil removed for analysis.

It is understood that the above description does not limit the invention to the precise form disclosed, but may be modified within the scope of the appended claims.

I claim:

1. In combination, a drilling auger having a hollow stem, a drill head having a hollow housing mounted to one end of said drilling auger, and a plug member including an annular rim positioned between said drill head and said auger hollow stem, said plug member further including a plurality of integral inturned projection means extending arcurately downwardly from said rim into said drill head hollow housing, said projection means including spaced projections having collapsing wall defining capabilities upon soil contact as the drill head is advanced into the soil for preventing said soil from entering said auger hollow stem through the plug member projection means, said plug member projection means formed of flexible shape-retaining material to allow a sampling tool to be pushed through the projection means into the underlying soil for withdrawing such soil.

2. The combination of claim 1 wherein each projection terminates at a generally equal distance from said axis.

* * * * *